US007347231B2

(12) United States Patent
Schmoll

(10) Patent No.: US 7,347,231 B2
(45) Date of Patent: Mar. 25, 2008

(54) BEVERAGE BOTTLING PLANT FOR FILLING BOTTLES WITH A LIQUID BEVERAGE HAVING A FILLING MACHINE FOR FILLING BOTTLES WITH A LIQUID BEVERAGE

(75) Inventor: Wolfgang Schmoll, Wallhausen (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 407 days.

(21) Appl. No.: 11/012,859

(22) Filed: Dec. 15, 2004

(65) Prior Publication Data

US 2005/0150571 A1 Jul. 14, 2005

(30) Foreign Application Priority Data

Dec. 20, 2003 (DE) ..... 203 19 789 U

(51) Int. Cl.
*B65B 31/00* (2006.01)

(52) U.S. Cl. ..... 141/52; 141/144; 141/145; 141/146

(58) Field of Classification Search ..... 141/52, 141/53, 57, 59, 144–147; 53/281–285
See application file for complete search history.

(56) References Cited

U.S. PATENT DOCUMENTS 5,501,253 A * 3/1996 Weiss ..... 141/40
5,634,500 A * 6/1997 Clusserath et al. ..... 141/48
6,189,578 B1 * 2/2001 Clusserath ..... 141/7
6,213,169 B1 * 4/2001 Clusserath ..... 141/49
6,308,752 B1 * 10/2001 Tsukano et al. ..... 141/290

FOREIGN PATENT DOCUMENTS

| | | |
|---|---|---|
| DE | 754 877 C | 10/1954 |
| DE | 28 56 944 B1 | 4/1980 |
| DE | 30 25 786 A1 | 2/1982 |
| DE | 37 31 759 A1 | 3/1989 |
| DE | 39 28 009 A1 | 2/1991 |
| DE | 42 43 001 A1 | 6/1994 |
| DE | 100 25 577 A1 | 2/2001 |
| EP | 0 051890 A | 5/1982 |
| EP | 1 262 446 A | 12/2002 |

OTHER PUBLICATIONS

European Patent Office Search Report EP 04 01 9340 and English translation thereof.

* cited by examiner

*Primary Examiner*—Timothy L. Maust
(74) *Attorney, Agent, or Firm*—Nils H. Ljungman & Associates

(57) ABSTRACT

Beverage bottling plant for filling bottles with a liquid beverage having a filling machine for filling bottles and other beverage containers with a liquid beverage. The filling machine having a gas tube being configured and disposed to permit evacuation of gas from a beverage bottle to a chamber of a return gas duct without the gas contacting liquid beverage material in a beverage storage reservoir to essentially prevent contamination of the liquid beverage material in said beverage storage reservoir by the gas being evacuated from the beverage bottle.

20 Claims, 5 Drawing Sheets

BEVERAGE BOTTLING PLANT FOR FILLING BOTTLES WITH A LIQUID BEVERAGE HAVING A FILLING MACHINE FOR FILLING BOTTLES WITH A LIQUID BEVERAGE

BACKGROUND

1. Technical Field

The present application relates to a beverage bottling plant for filling bottles with a liquid beverage having a filling machine as described herein below.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

On filling machines for filling containers such as bottles, cans, canisters etc., it has been known for a long time that before the filling, the containers to be filled can first be treated with a vacuum and an inert gas such as $CO_2$ or steam, for example. The purpose of this flushing is to reduce the germ content and oxygen content inside the containers.

For reasons of health and to increase shelf life, this process is customarily used in the bottling of liquids that are bacteriologically critical and/or oxygen-sensitive. The gases that must thereby be removed from the containers are generally removed via separate gas paths or ducts.

In addition to the use of separate gas paths or ducts, the prior art also describes configurations in which the gas is removed from the containers using what is termed a return gas pipe.

These return gas pipes, which in numerous configurations of filling machines are also used to exhaust the gas that escapes during the filling process from the containers being filled, generally empty into the storage reservoir for the goods being bottled, where they end above the fluid level in said storage reservoir.

In configurations of this type, in which ambient air, or at least the flushing gas that has been in contact with the container comes directly into contact with the liquid being bottled, there is necessarily an increased risk of contamination of the goods being bottled. This risk is particularly high if the return gas and the goods being bottled come into contact with each other over large areas.

DE 37 31 759 discloses the location on the peripheral surface of a ring bowl of a plurality of separate filling mechanisms that have a defined liquid volume to hold the liquid being bottled and a gas space that is located above the liquid being bottled. In this apparatus of the prior art, the respective return gas tube ends inside this separate filling mechanism. In this configuration, of course, the return gas initially comes into contact only with the volume of liquid being bottled that is located in the filling mechanism itself, as a result of which the risk of contamination is reduced, although it is impossible to fully rule out a more serious contamination of the liquid being bottled, because the return gas from any filling mechanism can travel through a large-diameter passage opening into the ring bowl.

DE 39 28 009 describes a filling machine with a separate return gas duct that is located above the storage reservoir. In this device, the return gas is transported via an additional shuttle valve either into the storage reservoir for the liquid being bottled and/or into the return gas duct. DE 39 28 009 also teaches that the pressure in the return gas duct is set lower than the pressure in the storage reservoir. Because of the shuttle valve that is provided and the different pressure settings, however, such a device is mechanically complex and expensive to manufacture.

OBJECT OR OBJECTS

The object of this invention is to substantially reduce or essentially eliminate the disadvantages described above. For this purpose the invention teaches a filling machine in which a return gas tube ends directly in a separate return gas duct, whereby said return gas duct is connected with the storage reservoir through an opening that has a small cross section area, and the return gas duct and storage reservoir are connected with a common source of negative pressure or vacuum and are at essentially the same pressure.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

This invention is explained in greater detail below on the basis of one exemplary embodiment.

DESCRIPTION OF EMBODIMENT OR EMBODIMENTS

Developments, advantages and potential applications of the invention are described below with reference to exemplary embodiments and to the accompanying drawings. All the features described and/or illustrated, individually or in any desired combination, are the object of the invention regardless of their combination or placement in the claims or the references to other claims. The text of the claims is also integrated by reference into the description.

Figure 1:
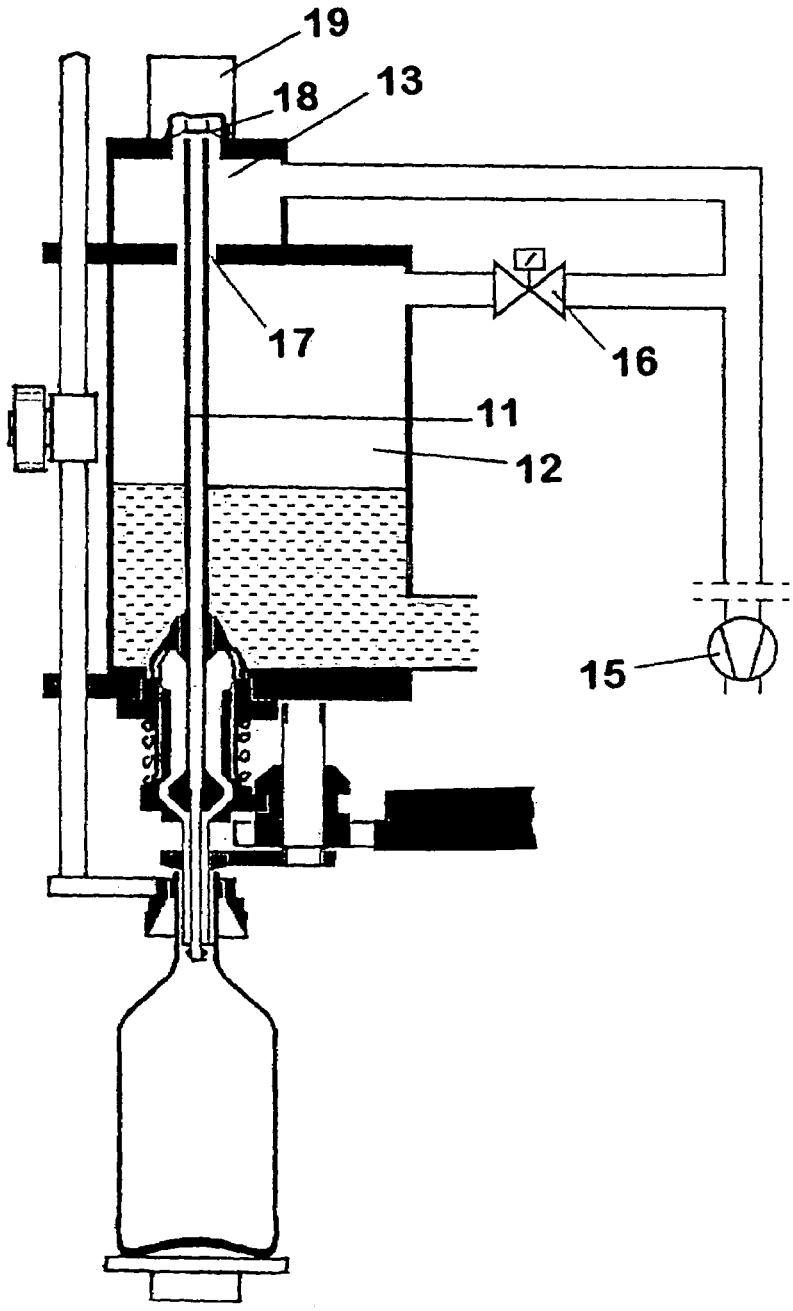
FIG. 1 is a simplified illustration of portions of a filling machine as claimed by the invention.
Figure 1A:
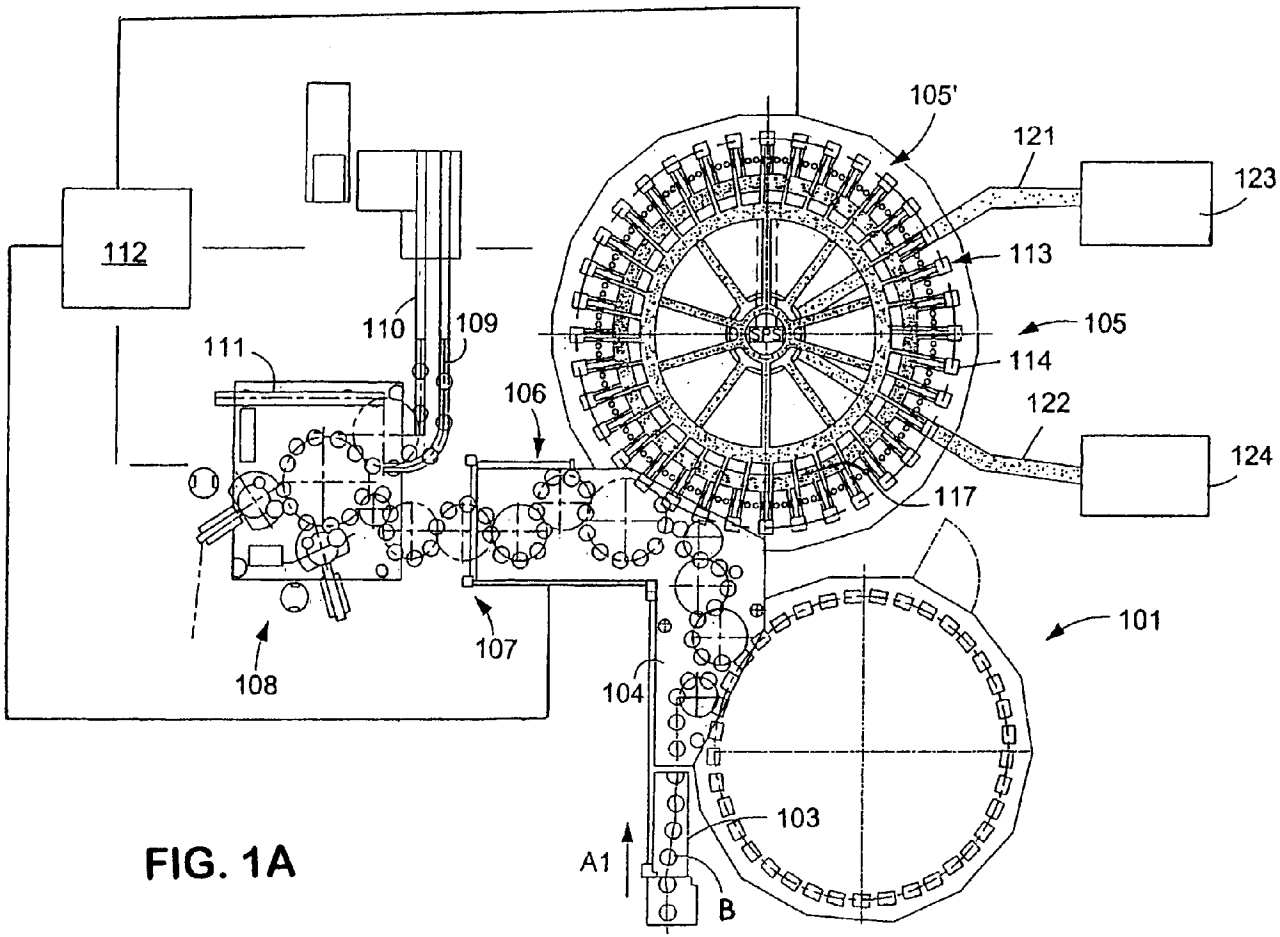
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling, machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The exemplary embodiment illustrated in FIG. 1 is a filling machine with a rotary-type construction, with a plurality of filling stations arranged on its periphery. Associated with each of these filling stations are, among other things, a centering element, a liquid valve and a return gas pipe 11. This return gas pipe 11 is located in the center of the liquid valve, and extends from the interior of the reservoir mouth to inside the return gas duct 13, whereby it runs all the way through the storage reservoir 12 that holds the liquid 20 being bottled.

The return gas duct 13 is located above the storage reservoir 12 and is advantageously realized in the form of an encircling, fully closed annular duct. However, it is possible that other duct shapes and/or locations may also be useful.

The return gas duct 13 and the storage reservoir 12 are connected to a joint source 15 of negative pressure or vacuum, whereby the connection to the storage reservoir 12 is accomplished using a controllable or adjustable gas flow valve 16.

In an additional advantageous realization of the invention, the return gas duct 13 and the storage reservoir 12 are each equipped with their own vacuum or negative pressure source 15.

There is a boring 17 for each return gas pipe 11, which boring 17 is coordinated with the diameter of the return gas pipe 11, in the cover of the storage reservoir 12 and which makes it possible to run the return gas pipe 11 through the cover of the storage reservoir 12. The diameters of the return gas tube 11 and the boring 17 are preferably coordinated so that the connection between the return gas duct 13 and the storage reservoir 12 is realized in the form of a circular ring-shaped surface that has only a small surface area, as a result of which the potential for contact between the return gas and the liquid being bottled, and therefore the risk of contamination, can be significantly reduced.

In one possible embodiment, the boring 17 may be hermetically sealed around the return gas pipe 11 to prevent any contact between the return gas and the liquid being bottled, and therefore to prevent the risk of contamination, such as for the bottling of sensitive liquids like wine. In another possible embodiment, there may be no seal around the boring 17 and the return gas pipe 11.

Configurations in which the area of the circular ring-shaped surface is less than 100 $mm^2$ have been found to be particularly advantageous. It should be understood that the advantageous configuration of the circular ring-shaped surface of 100 $mm^2$ is particular to the experiments made with available machines, and therefore it is possible and within the scope of the application that, for other machines, other configurations or cross sections may possibly be found to be practical, optimal, or advantageous.

To prevent the unnecessary introduction of gas not required by the filling process into the storage reservoir 12 and/or the return gas duct 13, the invention teaches the use of means that make it possible to securely close the upper end of the return gas pipe 11. These means—as illustrated by way of example in the accompanying drawings—can be a membrane closure 18 actuated by a pneumatic cylinder 19, and/or tappets, pistons or other suitable sealing elements. With regard to the actuation of these means, e.g. pneumatically actuated means, the invention teaches that they can be actuated electronically, for example, by at least one computer or control computer. The control computer that is already present on the filling machine can be used for this purpose, too, for example.

During the flushing or filling, gas or return gas is removed from the reservoir, and when the membrane closure 18 is opened, said gas or return gas travels through the return gas tube 11 into the return gas duct 13. As a result of the advantageous configuration of the boring 17, the operation of the vacuum source 15 and the appropriate setting of the gas flow valve 16, it is possible to regulate the gas flow between the components, i.e. the return gas pipe 11, return gas duct 13 and the storage reservoir 12, and to define its direction so that the gases exiting the return gas tube 11 go directly to the vacuum source 15 and do not penetrate into the storage reservoir 12, as a result of which contact between the liquid being bottled and the return gas can be securely prevented or at least minimized.

The safety of the bottling process can be further increased by a low but continuous gas flow out of the storage reservoir 12 into the return gas duct 13, because this gas flow that passes the boring 17 blocks the path through the hold formed by 17 for the return gas.

This invention also makes it possible to almost completely prevent gas movements inside the storage reservoir 12, as a result of which, in particular with sensitive liquids being bottled such as wine or certain fruit juices for example, undesirable losses of alcohol and/or highly volatile flavoring agents can be significantly reduced or even prevented altogether.

Figure 1B:
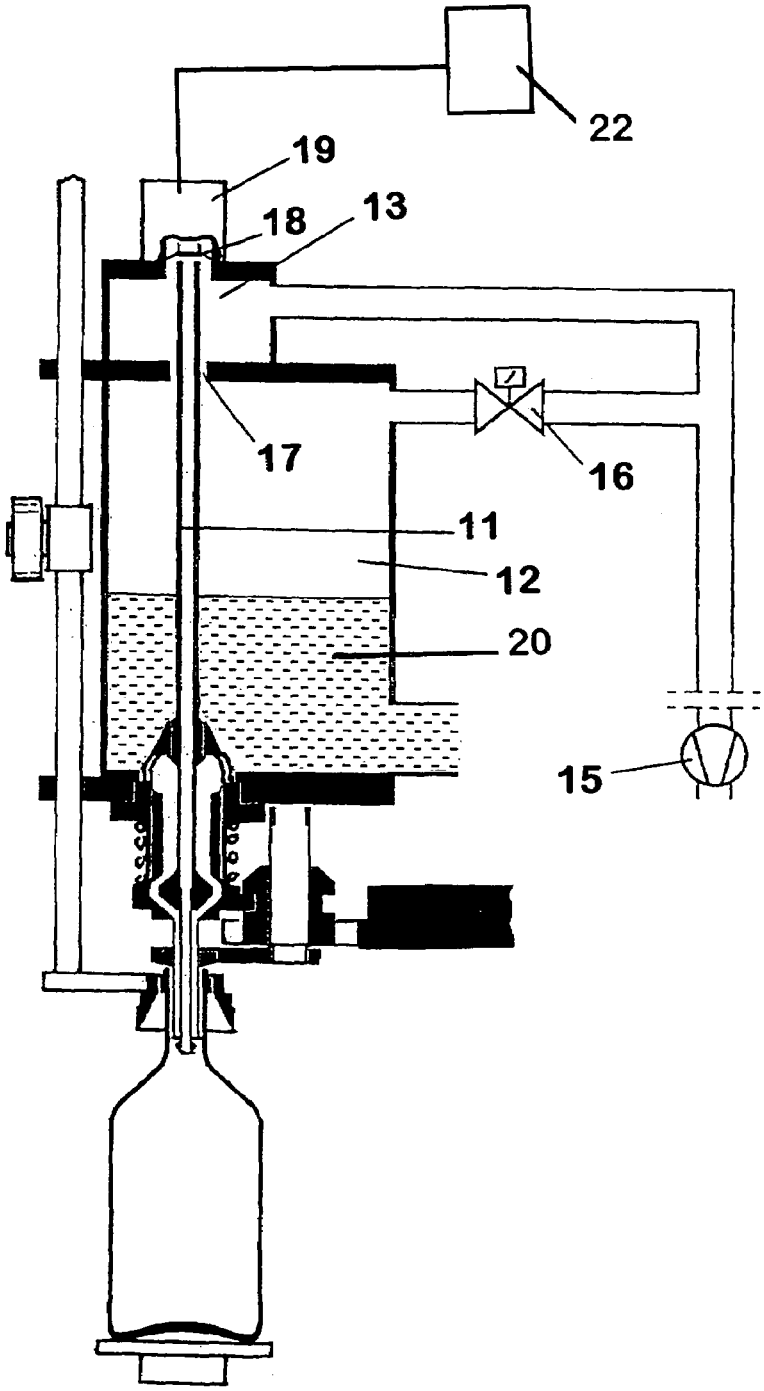
FIG. 1B is similar to FIG. 1, and shows further details.

FIG. 1B is similar to FIG. 1, and shows a control device or computer 22 for actuating and controlling the means to securely close the upper end of the return gas pipe 11, examples of which means are described herein.

Figure 1C:
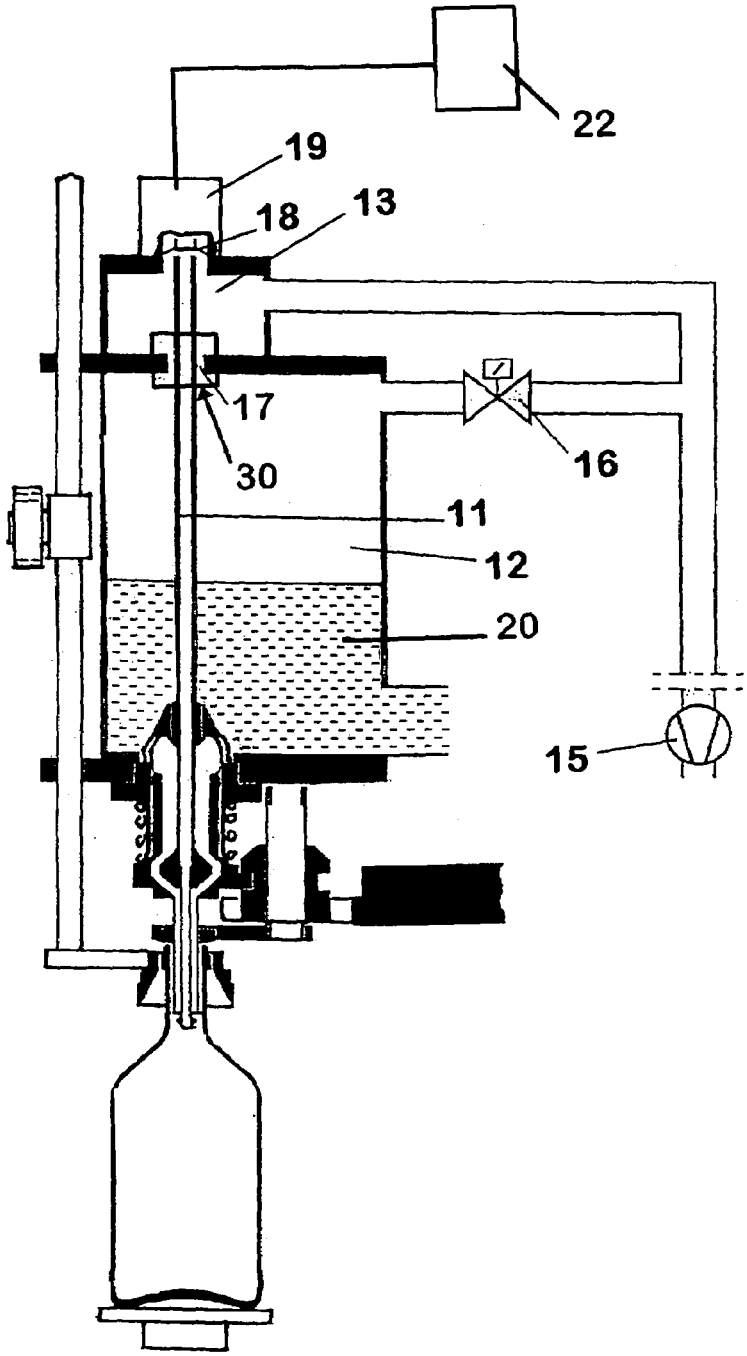
FIG. 1C is similar to FIG. 1, and shows an alternate embodiment.

FIG. 1C is similar to FIG. 1, and shows an embodiment where the boring 17 is hermetically sealed around the return gas pipe 11 to essentially prevent any contact between the return gas and the liquid being bottled, and therefore to essentially prevent the risk of contamination, such as for the bottling of sensitive liquids like wine. The hermetic seal is represented by a box 30 in FIG. 1C.

Figure 1D:
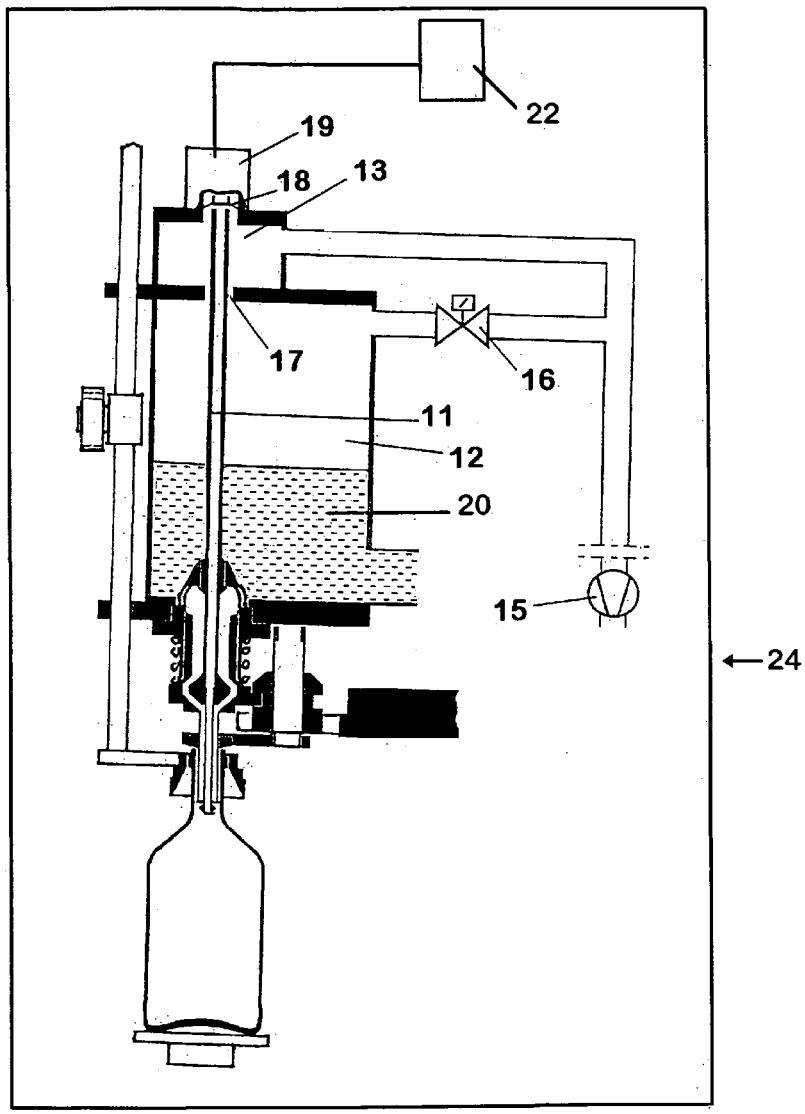
FIG. 1D is similar to FIG. 1, and shows an embodiment where the filling machine is enclosed in a clean room for aseptic bottling.

With reference to FIG. 1D, with an increased demand for higher quality and stability of durability of beverages in containers, there is at hand a type of arrangement in which the handling positions are disposed in a closed space that is supplied with a special atmosphere. Such a space can be supplied with an inert atmosphere such as carbon dioxide, with a sterilizing atmosphere, or with hydrogen peroxide, and thus can ensure a treatment of the beverage that is low in oxygen and low in germs, this being of paramount importance for the quality of the beverage supply that is to be filled into the containers. Such handling machines are known in many varieties in the beverage industry. FIG. 1D is similar to FIG. 1, and shows an embodiment where the filling machine is enclosed in a clean room for aseptic bottling, which clean room is represented by a box 24 around the filling machine.

One feature or aspect of an embodiment is believed at the time of the filing of this patent application to possibly reside broadly in a filling machine for filling containers such as bottles, cans or similar objects, in particular for filling said containers with oxygen-sensitive and/or still liquids such as wine, fruit juices and similar products, for example, with a valve for dispensing the liquid and a return gas tube, a storage reservoir for the liquid being bottled, characterized by the fact that the return gas tube empties directly into a separate return gas duct.

Another feature or aspect of an embodiment is believed at the time of the filing of this patent application to possibly reside broadly in a filling machine, characterized by the fact that the separate return gas duct is located above the storage reservoir.

Yet another feature or aspect of an embodiment is believed at the time of the filing of this patent application to possibly reside broadly in a filling machine, characterized by the fact that the return gas tube runs through the storage reservoir.

Still another feature or aspect of an embodiment is believed at the time of the filing of this patent application to possibly reside broadly in a filling machine, characterized by the fact that a vacuum and/or negative pressure can be applied to the return gas duct.

A further feature or aspect of an embodiment is believed at the time of the filing of this patent application to possibly reside broadly in a filling machine, characterized by the fact that a vacuum and/or negative pressure can be applied to the storage reservoir.

Another feature or aspect of an embodiment is believed at the time of the filing of this patent application to possibly reside broadly in a filling machines, characterized by the fact that there is a gas-permeable connection or a connection that lets gas through between the return gas duct and the storage reservoir.

Yet another feature or aspect of an embodiment is believed at the time of the filing of this patent application to possibly reside broadly in a filling machine, characterized by the fact that the connection that carries gas between the return gas duct and the storage reservoir is essentially in the shape of a circular ring.

Still another feature or aspect of an embodiment is believed at the time of the filing of this patent application to possibly reside broadly in a filling machine, characterized by the fact that the surface of the circular ring-shaped connection is less than 100 $mm^2$.

A further feature or aspect of an embodiment is believed at the time of the filing of this patent application to possibly reside broadly in a filling machine, characterized by the fact that the same pressure prevails in the storage reservoir and in the return gas duct.

Another feature or aspect of an embodiment is believed at the time of the filing of this patent application to possibly reside broadly in a filling machine, characterized by the fact that means are provided that make it possible to close the return gas pipe gas-tight.

Yet another feature or aspect of an embodiment is believed at the time of the filing of this patent application to possibly reside broadly in a filling machine, characterized by the fact that said means are sealing elements actuated by pneumatic cylinder.

Still another feature or aspect of an embodiment is believed at the time of the filing of this patent application to possibly reside broadly in a filling machine, characterized by the fact that said means are actuated by at least one computer.

A further feature or aspect of an embodiment is believed at the time of the filing of this patent application to possibly reside broadly in a filling machine, characterized by the fact that the return gas tube can be closed gas-tight on its upper end.

Another feature or aspect of an embodiment is believed at the time of the filing of this patent application to possibly reside broadly in a filling machine, characterized by the fact that the return gas duct and storage reservoir are each connected to a vacuum source.

Yet another feature or aspect of an embodiment is believed at the time of the filing of this patent application to possibly reside broadly in a filling machine, characterized by the fact that the return gas duct and storage reservoir are connected to a common vacuum source.

Still another feature or aspect of an embodiment is believed at the time of the filing of this patent application to possibly reside broadly in a filling machine, characterized by the fact that the vacuum source is connected with the storage reservoir by means of at least one adjustable and/or controllable gas flow valve.

Yet another feature or aspect of an embodiment is believed at the time of the filing of this patent application to possibly reside broadly in a beverage bottling plant for filling bottles with a liquid beverage having a filling machine for filling containers such as bottles, cans or similar objects, in particular for filling such containers with oxygen-sensitive and/or still liquids such as wine, fruit juices and similar products, for example, with a valve for dispensing the liquid and a return gas tube, a storage reservoir for the liquid being bottled, whereby the return gas tube empties directly into a separate return gas duct.

Another feature or aspect of an embodiment is believed at the time of the filing of this patent application to possibly reside broadly in a beverage bottling plant for filling beverage bottles with liquid beverage material, such as wines, fruit juices, and other similar beverages, said beverage bottling plant comprising: a beverage bottle cleaning machine being configured and disposed to clean beverage bottles; a feed arrangement to supply beverage bottles to said beverage bottle cleaning machine; a beverage filling machine being configured and disposed to fill beverage bottles with liquid beverage material; said beverage filling machine comprising a plurality of beverage filling devices for filling beverage bottles with liquid beverage material; said beverage filling machine comprising a beverage storage reservoir being configured and disposed to store liquid beverage material; said beverage storage reservoir comprising a pressure chamber being configured to be pressurized by a gas; at least one storage unit being configured and disposed to store a supply of liquid beverage material; at least one supply line being configured and disposed to connect said at least one storage unit to said beverage filling machine to supply liquid beverage material to said beverage storage reservoir; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling machine to said beverage bottle packing station; said fourth conveyer arrangement comprising a linear conveyor structure being configured and disposed to arrange beverage bottles in groups for packing; each of said beverage filling devices comprising: a dispensing apparatus being configured and disposed to dispense liquid beverage material from said beverage storage reservoir into beverage bottles; a gas evacuation arrangement being configured and disposed to evacuate gas from a beverage bottle upon dispensing of liquid beverage material into the beverage bottle; said gas evacuation arrangement comprising: a return gas duct being configured and disposed to permit evacuation of gas from a beverage bottle upon dispensing of liquid beverage material into the beverage bottle; said return gas duct comprising a chamber separate from said beverage storage reservoir configured to minimize contact of gas being evacuated from a beverage bottle with liquid beverage material in said beverage storage reservoir to essentially prevent contamination of the liquid beverage material in said beverage storage reservoir by the gas; a return gas tube being configured and disposed to permit evacuation of gas from beverage bottles upon dispensing of liquid beverage material into the beverage bottle; said return gas tube comprising a first end portion being configured and disposed to extend through and out of said dispensing apparatus and into a beverage bottle to be filled with liquid beverage material; said return gas tube comprising a second end portion opposite said first end portion being disposed in said chamber of said return gas duct; said return gas tube comprising a middle portion disposed in said beverage storage reservoir connecting said first end portion and said second end portion; and said return gas tube being configured and disposed to permit evacuation of gas from a beverage bottle to said chamber of said return gas duct without the gas contacting liquid beverage material in said beverage storage reservoir to essentially prevent contamination of the liquid beverage material in said beverage storage reservoir by the gas being evacuated from the beverage bottle.

Yet another feature or aspect of an embodiment is believed at the time of the filing of this patent application to possibly reside broadly in the beverage bottling plant, wherein said beverage filling machine comprises a beverage filling machine for filling containers such as bottles, cans or similar objects, in particular for filling said containers with oxygen-sensitive and/or still liquids such as wine, fruit juices and similar products, for example, with a valve for dispensing the liquid and a return gas tube, a storage reservoir for the liquid being bottled, characterized by the fact that the return gas tube empties directly into a separate return gas duct.

Still another feature or aspect of an embodiment is believed at the time of the filing of this patent application to possibly reside broadly in the beverage bottling plant, wherein: said separate return gas duct is located above said storage reservoir; and said gas evacuation arrangement comprises one of: a vacuum arrangement configured to apply a vacuum pressure to at least one of: said return gas duct and said storage reservoir; and a negative pressure arrangement is configured to apply a negative pressure to at least one of: said return gas duct and said storage reservoir.

A further feature or aspect of an embodiment is believed at the time of the filing of this patent application to possibly reside broadly in the beverage bottling plant, wherein at least one of (A), (B), (C), and (D): (A) said return gas duct and said storage reservoir are connected by a connection that lets gas through between said return gas duct and said storage reservoir; said connection that carries gas between said return gas duct and said storage reservoir is essentially in the shape of a circular ring; and said circular ring-shaped connection has a surface area of less than 100 $mm^2$; (B) essentially the same pressure prevails in said storage reservoir and in said return gas duct; (C) said return gas duct comprises an arrangement configured and disposed to sealingly engage and close said second end of said return gas tube gas-tight; said sealing arrangement comprises sealing elements actuated by pneumatic cylinder; and said sealing arrangement is configured to be actuated by at least one computer; and (D) one of (i) and (ii): (i) said gas evacuation arrangement comprises at least a first vacuum source connected to said return gas duct, and a second, separate vacuum source connected to said storage reservoir; and said second vacuum source is connected to said storage reservoir by means of at least one adjustable and/or controllable gas flow valve; and (ii) said gas evacuation arrangement comprises a vacuum source connected to said return gas duct and said storage reservoir; and said vacuum source is connected to said storage reservoir by means of at least one adjustable and/or controllable gas flow valve.

The components disclosed in the various publications, disclosed or incorporated by reference herein, may possibly be used in possible embodiments of the present invention, as well as equivalents thereof.

Some examples of bottling systems that may possibly be utilized or possibly adapted for use in at least one possible embodiment of the present application may possibly be found in the following U.S. patents, all assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003. claims in any manner.

The appended drawings in their entirety, including all dimensions, proportions and/or shapes in at least one embodiment of the invention, are accurate and are hereby included by reference into this specification.

Some examples of sensors that may possibly be utilized or possibly adapted for use in at least one possible embodiment of the present application may possibly be found in the following U.S. Patents: U.S. Pat. No. 6,062,248 issued to Boelkins on May 16, 2000; U.S. Pat. No. 6,223,593 issued to Kubisiak et al. on May 1, 2001; U.S. Pat. No. 6,466,035 issued to Nyfors et al. on Oct. 15, 2002; U.S. Pat. No. 6,584,851 issued to Yamagishi et al. on Jul. 1, 2003; U.S. Pat. No. 6,631,638 issued to James et al. on Oct. 14, 2003; and U.S. Pat. No. 6,707,307 issued to McFarlane et al. on Mar. 16, 2004.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No.

4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

All, or substantially all, of the components and methods of the various embodiments may be used with at least one embodiment or all of the embodiments, if more than one embodiment is described herein.

Some examples of bottling systems which may possibly be utilized or adapted for use in at least one possible embodiment may possibly be found in the following U.S. patents: U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of starwheels which may possibly be utilized or adapted for use in at least one possible embodiment may possibly be found in the following U.S. Patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

All of the patents, patent applications and publications recited herein, and in the Declaration attached hereto, are hereby incorporated by reference as if set forth in their entirety herein.

Some examples of centering devices for bottle handling devices which may possibly be utilized or adapted for use in at least one possible embodiment may possibly be found in Federal Republic of Germany Application No. DE P 103 14 634, entitled "Spülbares Huborgan" having inventor Herbert Bernhard, and its U.S. equivalent, having Ser. No. 10/813,657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, entitled "Huborgan zum Anpressen von Gefässen an Gefässfüllmaschinen" having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004 and having Attorney Reference No. NHL-HOL-72. The above applications are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of synchronous motors which may possibly be utilized or adapted for use in at least one possible embodiment may possibly be found in the following U.S. Patents: U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of computer systems that may possibly be utilized or possibly adapted for use in at least one possible embodiment of the present application may possibly be found in the following U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

The corresponding foreign and international patent publication applications, namely, Federal Republic of Germany Patent Application No. 203 19 789.5, filed on Dec. 20, 2003, having inventor Wolfgang Schmoll, and 203 19 789.5 and DE-PS 203 19 789.5, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of seal arrangements that may possibly be utilized or possibly adapted for use in at least one possible embodiment of the present application may possibly be found in the following U.S. Patents: U.S. Pat. No. 4,010,960 issued to Martin on Mar. 8, 1977; U.S. Pat. No. 5,411,273 issued to Pietsch et al. on May 2, 1995; U.S. Pat. No. 5,375,852 issued to Charhut on Dec. 27, 1994; U.S. Pat. No. 6,189,896 issued to Dickey et al. on Feb. 20, 2002: U.S. Pat. No. 6,692,007 issued to Oldenburg on Feb. 17, 2004; and U.S. Pat. No. 6,648,335 issued to Ezell on Nov. 18, 2003.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of filling machines that utilize electronic control devices to control various portions of a filling or bottling process and that may possibly be utilized or possibly adapted for use in at least one possible embodiment of the present application may possibly be found in the following U.S. patents: U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A beverage bottling plant for filling beverage bottles with liquid beverage material, such as wines, fruit juices, and other similar beverages, said beverage bottling plant comprising:

a beverage bottle cleaning machine being configured and disposed to clean beverage bottles;

a feed arrangement to supply beverage bottles to said beverage bottle cleaning machine;

a beverage filling machine being configured and disposed to fill beverage bottles with liquid beverage material;

said beverage filling machine comprising a plurality of beverage filling devices for filling beverage bottles with liquid beverage material;

said beverage filling machine comprising a beverage storage reservoir being configured and disposed to store liquid beverage material;

said beverage storage reservoir comprising a pressure chamber being configured to be pressurized by a gas;

at least one storage unit being configured and disposed to store a supply of liquid beverage material;

at least one supply line being configured and disposed to connect said at least one storage unit to said beverage filling machine to supply liquid beverage material to said beverage storage reservoir;

a first conveyer arrangement being configured and disposed to move beverage bottles from said beverage bottle cleaning machine into said beverage filling machine;

said first conveyer arrangement comprising a star wheel structure;

a beverage bottle closing machine being configured and disposed to close tops of filled beverage bottles;

a second conveyer arrangement being configured and disposed to move filled beverage bottles from said beverage filling machine into said beverage bottle closing machine;

said second conveyer arrangement comprising a star wheel structure;

a beverage bottle labeling machine being configured and disposed to label filled, closed beverage bottles;

a third conveyor arrangement being configured and disposed to move filled, closed beverage bottles from said beverage bottle closing machine into said beverage bottle labeling machine;

said third conveyer arrangement comprising a star wheel structure;

a beverage bottle packing station being configured and disposed to package labeled, filled, closed beverage bottles;

a fourth conveyor arrangement being configured and disposed to move labeled, filled, closed beverage bottles from said beverage bottle labeling machine to said beverage bottle packing station;

said fourth conveyer arrangement comprising a linear conveyor structure being configured and disposed to arrange beverage bottles in groups for packing;

each of said beverage filling devices comprising:

a dispensing apparatus being configured and disposed to dispense liquid beverage material from said beverage storage reservoir into beverage bottles;

a gas evacuation arrangement being configured and disposed to evacuate gas from a beverage bottle upon dispensing of liquid beverage material into the beverage bottle;

said gas evacuation arrangement comprising:

a return gas duct being configured and disposed to permit evacuation of gas from a beverage bottle upon dispensing of liquid beverage material into the beverage bottle;

said return gas duct comprising a chamber separate from said beverage storage reservoir configured to minimize contact of gas being evacuated from a beverage bottle with liquid beverage material in said beverage storage reservoir to essentially prevent contamination of the liquid beverage material in said beverage storage reservoir by the gas;

a return gas tube being configured and disposed to permit evacuation of gas from beverage bottles upon dispensing of liquid beverage material into the beverage bottle;

said return gas tube comprising a first end portion being configured and disposed to extend through and out of said dispensing apparatus and into a beverage bottle to be filled with liquid beverage material;

said return gas tube comprising a second end portion opposite said first end portion being disposed in said chamber of said return gas duct;

said return gas tube comprising a middle portion disposed in said beverage storage reservoir connecting said first end portion and said second end portion; and said return gas tube being configured and disposed to permit evacuation of gas from a beverage bottle to said chamber of said return gas duct without the gas contacting liquid beverage material in said beverage storage reservoir to essentially prevent contamination of the liquid beverage material in said beverage storage reservoir by the gas being evacuated from the beverage bottle.

2. The beverage bottling plant according to claim 1, wherein:

said separate return gas duct is located above said storage reservoir; and said gas evacuation arrangement comprises one of:

a vacuum arrangement configured to apply a vacuum pressure to at least one of: said return gas duct and said storage reservoir; and a negative pressure arrangement is configured to apply a negative pressure to at least one of: said return gas duct and said storage reservoir.

3. The beverage bottling plant according to claim 2, wherein at least one of (A), (B), (C), and (D):

(A) said return gas duct and said storage reservoir are connected by a connection that lets gas through between said return gas duct and said storage reservoir;

said connection that carries gas between said return gas duct and said storage reservoir is essentially in the shape of a circular ring; and said circular ring-shaped connection has a surface area of less than 100 $mm^2$;

(B) essentially the same pressure prevails in said storage reservoir and in said return gas duct;

(C) said return gas duct comprises an arrangement configured and disposed to sealingly engage and close said second end of said return gas tube gas-tight;

said sealing arrangement comprises sealing elements actuated by pneumatic cylinder; and said sealing arrangement is configured to be actuated by at least one computer; and (D) one of (i) and (ii):

(i) said gas evacuation arrangement comprises at least a first vacuum source connected to said return gas duct, and a second, separate vacuum source connected to said storage reservoir; and said second vacuum source is connected to said storage reservoir by means of at least one adjustable and/or controllable gas flow valve; and (ii) said gas evacuation arrangement comprises a vacuum source connected to said return gas duct and said storage reservoir; and said vacuum source is connected to said storage reservoir by means of at least one adjustable and/or controllable gas flow valve.

4. A container filling plant for filling containers with oxygen-sensitive liquid material, such as wines, fruit juices, and other similar liquids, said container filling plant comprising:

a filling machine being configured and disposed to fill containers with oxygen-sensitive liquid material;

said filling machine comprising a plurality of filling devices for filling containers;

said filling machine comprising a storage reservoir being configured and disposed to store oxygen-sensitive liquid material;

said storage reservoir comprising a pressure chamber being configured to be pressurized by a gas;

a first conveyer arrangement being configured and disposed to move containers into said filling machine;

a container closing machine being configured and disposed to close filled containers;

a second conveyer arrangement being configured and disposed to move filled containers from said filling machine into said closing machine;

a packing station being configured and disposed to pack filled, closed containers;

a third conveyor arrangement being configured and disposed to move filled, closed containers from said closing machine to said packing station;

each of said filling devices comprising:

a dispensing apparatus being configured and disposed to dispense oxygen-sensitive liquid material from said storage reservoir into containers;

a gas evacuation arrangement being configured and disposed to evacuate gas from a container upon dispensing of oxygen-sensitive liquid material into the container;

said gas evacuation arrangement comprising:

a return gas duct being configured and disposed to permit evacuation of gas from a container upon dispensing of oxygen-sensitive liquid material into the container;

said return gas duct comprising a chamber separate from said storage reservoir, said chamber being configured and disposed to minimize contact of gas being evacuated from a container with oxygen-sensitive liquid material in said storage reservoir to minimize contamination of the oxygen-sensitive liquid material in said storage reservoir by the gas;

a return gas tube being configured and disposed to permit evacuation of gas from a container upon dispensing of oxygen-sensitive liquid material into the container;

said return gas tube comprising a first end portion being configured and disposed to extend through and out of said dispensing apparatus and into a container to be filled with oxygen-sensitive liquid material;

said return gas tube comprising a second end portion opposite said first end portion being disposed in said chamber of said return gas duct;

said return gas tube comprising a middle portion disposed in said storage reservoir, said middle portion being disposed to connect said first end portion and said second end portion; and said return gas tube being configured and disposed to permit evacuation of gas from a container to said chamber of said return gas duct without the gas contacting oxygen-sensitive liquid material in said storage reservoir to minimize contamination of the oxygen-sensitive liquid material in said storage reservoir by the gas being evacuated from the container.

5. The container filling plant according to claim 4, wherein said separate return gas duct is located above said storage reservoir.

6. The container filling plant according to claim 5, wherein said gas evacuation arrangement comprises one of:

a vacuum arrangement configured to apply a vacuum pressure to at least one of: said return gas duct and said storage reservoir; and a negative pressure arrangement is configured to apply a negative pressure to at least one of: said return gas duct and said storage reservoir.

7. The container filling plant according to claim 6, wherein said return gas duct and said storage reservoir are connected by a connection that lets gas through between said return gas duct and said storage reservoir.

8. The container filling plant according to claim 7, wherein said connection that carries gas between said return gas duct and said storage reservoir is essentially in the shape of a circular ring.

9. The container filling plant according to claim 8, wherein said circular ring-shaped connection has a surface area of less than 100 $mm^2$.

10. The container filling plant according to claim 9, wherein essentially the same pressure prevails in said storage reservoir and in said return gas duct.

11. The container filling plant according to claim 10, wherein said return gas duct comprises an arrangement configured and disposed to sealingly engage and close said return gas tube gas-tight.

12. The container filling plant according to claim 11, wherein said sealing arrangement comprises sealing elements actuated by pneumatic cylinder.

13. The container filling plant according to claim 12, wherein said sealing arrangement is configured to be actuated by at least one computer.

14. The container filling plant according to claim 13, wherein sealing arrangement is configured to close second end portion of said return gas tube.

15. The container filling plant according to claim 14, wherein said gas evacuation arrangement comprises at least a first vacuum source connected to said return gas duct, and a second, separate vacuum source connected to said storage reservoir.

16. The container filling plant according to claim 15, wherein said second vacuum source is connected to said storage reservoir by means of at least one adjustable and/or controllable gas flow valve.

17. The container filling plant according to claim 14, wherein said gas evacuation arrangement comprises a vacuum source connected to said return gas duct and said storage reservoir.

18. The container filling plant according to claim 17, wherein said vacuum source is connected to said storage reservoir by means of at least one adjustable and/or controllable gas flow valve.

19. The container filling plant according to claim 4, wherein said return gas duct and said storage reservoir are connected by a connection that lets gas through between said return gas duct and said storage reservoir.

20. The container filling plant according to claim 9, wherein:

said connection that carries gas between said return gas duct and said storage reservoir is essentially in the shape of a circular ring; and said circular ring-shaped connection has a surface area of less than 100 $mm^2$.

* * * * *